US008920662B2

(12) United States Patent
Takeuchi

(10) Patent No.: US 8,920,662 B2
(45) **Date of Patent: *Dec. 30, 2014**

(54) NOZZLE PLATE MANUFACTURING METHOD, NOZZLE PLATE, DROPLET DISCHARGE HEAD MANUFACTURING METHOD, DROPLET DISCHARGE HEAD, AND PRINTER

(71) Applicant: Seiko Epson Corporation, Tokyo (JP)

(72) Inventor: Junichi Takeuchi, Chino (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/775,918

(22) Filed: Feb. 25, 2013

(65) Prior Publication Data

US 2013/0162720 A1 Jun. 27, 2013

Related U.S. Application Data

(63) Continuation of application No. 12/730,672, filed on Mar. 24, 2010, now Pat. No. 8,435,414.

(30) Foreign Application Priority Data

Apr. 1, 2009 (JP) ..... 2009-088694

(51) Int. Cl.
*B41J 2/14* (2006.01)
*B41J 2/16* (2006.01)

(52) U.S. Cl.
CPC ..... *B41J 2/162* (2013.01); *B41J 2/1632* (2013.01); *B41J 2/1628* (2013.01)
USPC ..... 216/27; 216/17; 216/41; 216/58; 216/79

(58) Field of Classification Search
CPC ..... B41J 2/1628; B41J 2/1632; B41J 2/162; B41J 2/1623; B41J 2/1629; B41J 2/16; B41J 2/1433; B41J 2/1631
USPC ..... 216/17, 27, 41, 58, 79
See application file for complete search history.

(56) References Cited

U.S. PATENT DOCUMENTS 6,523,762 B1 2/2003 Luginbuhl et al.
7,434,913 B2 10/2008 Suzuki et al.
7,582,495 B2 9/2009 Suzuki et al.

(Continued)

FOREIGN PATENT DOCUMENTS

JP 04-176657 6/1992
JP 04-339659 B2 11/1992

(Continued)

OTHER PUBLICATIONS

News Release from DISCO Corporation, "TAIKO Process" (URL:http://www.disco.co.jp/eg/solution/library/taiko.html), Dec. 6, 2006; Author Unknown.

*Primary Examiner* — Shamim Ahmed
(74) *Attorney, Agent, or Firm* — Harness, Dickey & Pierce, P.L.C.

(57) ABSTRACT

A nozzle plate manufacturing method that offers excellent protection against discharge liquid and that enables a nozzle plate having high nozzle-hole accuracy to be manufactured with good yield. The invention also provides a nozzle plate, a droplet discharge head manufacturing method, and a droplet discharge head.

27 Claims, 11 Drawing Sheets

(56) References Cited

U.S. PATENT DOCUMENTS

| | | | | |
|---|---|---|---|---|
| 8,043,518 | B2 | 10/2011 | Takahashi | |
| 2001/0024219 | A1 | 9/2001 | Kanda et al. | |
| 2007/0200877 | A1 | 8/2007 | Arakawa | |
| 2008/0239000 | A1 | 10/2008 | Ohta | |
| 2010/0134560 | A1* | 6/2010 | Doi et al. | 347/47 |

FOREIGN PATENT DOCUMENTS

| | | | |
|---|---|---|---|
| JP | 2001-260361 | A | 9/2001 |
| JP | 2005-231274 | | 9/2005 |
| JP | 2005-246609 | | 9/2005 |
| JP | 2006044226 | | 2/2006 |
| JP | 2007038570 | | 2/2007 |
| JP | 2007-168344 | | 7/2007 |
| JP | 2007-253608 | A | 10/2007 |
| JP | 2007-261152 | | 10/2007 |
| JP | 2008221653 | | 9/2008 |
| JP | 2008-264951 | | 11/2008 |
| JP | 2008-265007 | | 11/2008 |
| JP | 2009-248443 | | 10/2009 |
| JP | 2009-292080 | | 12/2009 |
| JP | 2010-115892 | | 5/2010 |

* cited by examiner

NOZZLE PLATE MANUFACTURING METHOD, NOZZLE PLATE, DROPLET DISCHARGE HEAD MANUFACTURING METHOD, DROPLET DISCHARGE HEAD, AND PRINTER

CROSS REFERENCE TO RELATED APPLICATIONS

This is a continuation patent application of U.S. application Ser. No. 12/730,672 filed Mar. 24, 2010, now U.S. Pat. No. 8,435,414 issued May 7, 2013, which claims priority to the entire disclosure of Japanese Patent Application No. 2009-088694, filed Apr. 1, 2009 all of which are expressly incorporated by reference herein in their entireties.

BACKGROUND

1. Technical Field

The present invention relates to manufacturing methods of a nozzle plate having nozzle holes to discharge droplets. The invention also relates to nozzle plates, droplet discharge head manufacturing methods, and droplet discharge heads.

2. Related Art

An inkjet head installed in, for example, an inkjet recording apparatus is a known example of a droplet discharge head that uses a nozzle plate for the discharge of droplets. Such inkjet heads generally include a nozzle plate having a plurality of nozzle holes provided for the discharge of ink droplets, and a cavity plate bonded to the nozzle plate and that includes ink channels such as pressure chambers and a reservoir in communication with the nozzle holes of the nozzle plate. The pressure applied to the pressure chambers by a driving section causes the ink droplets to discharge through selected nozzle holes. The driving method includes a scheme that uses electrostatic force, a piezoelectric scheme that uses a piezoelectric element, and a Bubble Jet® scheme that uses a heater element.

In response to the recent demand for high-quality inkjet head in terms of print and image qualities for example, there is a strong need to improve density and discharge performance. Under these circumstances, various ideas and proposals have been set forth concerning the nozzle portion of the inkjet head.

To improve ink discharge characteristics, it is desirable to adjust the channel resistance in the nozzle hole portion, and to adjust the substrate thickness to provide the optimum nozzle length. Another way to improve discharge characteristics is to align the direction of ink pressure on the nozzle with the nozzle axial direction through the use of a two-stage nozzle having a first nozzle portion (ink discharge side) and a second nozzle portion (ink supply side) of different inner diameters, instead of a nozzle that is cylindrical throughout.

A nozzle plate having the nozzle holes of such a multistage structure can be manufactured by the following method. Specifically, a two-stage depression that eventually becomes a first nozzle portion and a second nozzle portion is formed by the anisotropic dry etching of one of the surfaces of a silicon substrate using ICP discharge. Then, a liquid-resistant protective film ($SiO_2$ film) having ink resistance is formed by thermal oxidation over the silicon substrate. With this surface of the silicon substrate supported on a support substrate, the thickness of the silicon substrate is reduced by grinding from the other surface (hereinafter, "discharge face"). The bottom of the two-stage depression is removed in the process of thickness reduction, and as a result a two-stage nozzle is formed. With the etched surface of the silicon substrate supported on the support substrate, a liquid-resistant protective film having ink resistance is formed on the discharge face, which is then subjected to an ink repellent treatment. Here, the inner wall of the nozzle hole (the first nozzle portion and the second nozzle portion) is also subjected to an ink repellent treatment. Then, a support tape is attached to the discharge face, and the support substrate is detached. The ink repellent layer remaining on the inner wall of the nozzle hole is then removed by performing a plasma treatment from the etched surface. The support tape is then detached to complete the nozzle plate (see, for example, JP-A-2007-168344; FIG. 5 to FIG. 8).

In the foregoing publication, grinding is performed from the bottom side of the depression (discharge face side) after forming the two-stage depression that eventually becomes the nozzle hole. This causes a defect called chipping on the periphery of the discharge opening of the nozzle hole, leading to a reduced yield.

Further, because another liquid-resistant protective film is formed on the discharge face after forming the liquid-resistant protective film on the inner wall of the nozzle hole, there is a boundary between these liquid-resistant protective films. Such boundaries cause the ink droplets to seep in and cause damage to the silicon substrate under protection. The boundaries are particularly problematic because they occur at the discharge opening portion of the first nozzle portion where high dimensional accuracy is required. Accordingly, there is a strong need to overcome such problems.

As described, the first nozzle portion having the discharge opening requires very high accuracy. In this regard, the technique disclosed in the foregoing publication fails to provide sufficient diameter accuracy for the discharge opening, because the first nozzle portion is formed by two rounds of etching that proceeds deep down towards the surface where the discharge opening is formed.

SUMMARY

An advantage of some aspects of the invention is to provide a nozzle plate manufacturing method that offers excellent protection against discharge liquid, and that enables a nozzle plate having high nozzle-hole accuracy to be manufactured with good yield. The invention also provides a nozzle plate, a droplet discharge head manufacturing method, and a droplet discharge head.

According to an aspect of the invention, there is provided a nozzle plate manufacturing method that includes: forming on a first surface of a silicon substrate a film to be a dry etching mask used to form a depression that becomes a first nozzle portion on a droplet discharge side of the silicon substrate, and dry etching the silicon substrate using the film to form the depression to be the first nozzle portion; sequentially forming a first liquid-resistant protective film having liquid resistance and etching resistance and a liquid repellent layer having liquid repellency over the whole of the first surface of the silicon substrate after removing the film used as the dry etching mask, the whole of the first surface including an inner wall of the depression; bonding a support substrate to the first surface of the silicon substrate, and reducing the silicon substrate to a desired thickness from a second surface side opposite from the support substrate; dry etching the silicon substrate from the second surface side until a bottom of the depression to be the first nozzle portion appears, so as to form a second nozzle portion disposed on a droplet supply side and in communication with the first nozzle portion, and to thereby form a nozzle hole from the first nozzle portion and the second nozzle portion; removing the first liquid-resistant protective film and the liquid repellent layer remaining at the bottom of the depression to be the first nozzle portion, and the liquid repellent layer remaining on an inner wall of the first nozzle portion; forming a second liquid-resistant protective film having liquid resistance over the whole of the second surface of the silicon substrate, the whole of the second surface including an inner wall of the nozzle hole; and detaching the support substrate from the silicon substrate.

This is advantageous in the following respects.

(1) Because the liquid-resistant protective film is formed over the whole surface of the silicon substrate after forming the depression that becomes the first nozzle portion in the silicon substrate, the liquid-resistant protective film can be continuously formed without any boundary between the inner wall of the first nozzle portion and the discharge face. This solves the problem of damage to the discharge opening due to ink corrosion caused in the method of the related art JP-A-2007-168344 in which liquid-resistant protective films are formed on the inner wall of the nozzle holes and on the discharge face in different steps.

(2) Because the second nozzle portion is formed after the thickness of the silicon substrate is reduced from the opposite side of the depression formed in advance to provide the first nozzle portion having a discharge opening, chipping does not occur in either the first nozzle portion or the second nozzle portion. This improves the yield.

(3) Because the surface patterned with the dry etching mask is the discharge face, the accuracy of nozzle diameter can be greatly improved. This makes it possible to provide a uniform shape or uniform dimensions for the discharge opening of each nozzle hole formed in the nozzle plate, thus providing uniform discharge characteristics for the ink droplets.

According to another aspect of the invention, there is provided a nozzle plate manufacturing method that includes: forming on a first surface of a silicon substrate a film to be a first dry etching mask used to form a depression that becomes a first nozzle portion on a droplet discharge side of the silicon substrate, and dry etching the silicon substrate using the film to form the depression to be the first nozzle portion; forming a second dry etching mask over whole surfaces of the silicon substrate after removing the film to be the first dry etching mask, the whole surfaces including an inner wall of the depression to be the first nozzle portion; reducing the silicon substrate to a desired thickness from a second surface side opposite from the droplet discharge side not throughout the second surface but over at least regions of the nozzle hole so as to maintain sufficient strength for the silicon substrate to be carried alone even with the reduced thickness; dry etching the silicon substrate from the second surface side until a bottom of the depression to be the first nozzle portion appears, so as to form a second nozzle portion disposed on a droplet supply side and in communication with the first nozzle portion, and to thereby form a nozzle hole from the first nozzle portion and the second nozzle portion; sequentially forming a first liquid-resistant protective film having liquid resistance and a liquid repellent layer having liquid repellency over the whole surfaces of the silicon substrate after removing all the films formed on the silicon substrate, the whole surfaces including an inner wall of the nozzle hole; and removing unnecessary portions of the liquid repellent layer except in portions around a discharge opening of the nozzle hole.

This is advantageous in the following respects (4) and (5), in addition to the foregoing advantages (1) to (3).

(4) Because the thickness reduction of the silicon substrate to adjust the nozzle length is performed not over the whole surface of the silicon substrate but over at least regions of the nozzle hole to maintain sufficient strength for the silicon substrate to be carried alone even with the reduced thickness, the support substrate is not required in any of the steps in the fabrication of the nozzle plate. This simplifies the manufacturing steps. Further, because the support substrate is not required, the problem of foreign objects, such as the adhesive used to bond the support substrate, remaining on the silicon substrate can be solved.

(5) Because the manufacturing method does not require a support substrate, the nozzle holes are not closed by other components such as the support substrate and are thus open on the both sides during washing, making it possible to desirably clean the inner side of the nozzle holes.

In the nozzle plate manufacturing method according to the aspect of the invention, the first liquid-resistant protective film is preferably a thermal oxidation film.

Because the first liquid-resistant protective film is formed on the inner wall of the nozzle hole and over the discharge opening, the first liquid-resistant protective film affects the dimensional accuracy of the nozzle hole. By using a dense and highly uniform thermal oxidation film with good thickness controllability for the first liquid-resistant protective film, the nozzle holes can be formed with high accuracy, and variation in nozzle hole diameter can be suppressed.

In the nozzle plate manufacturing method according to the aspect of the invention, the dry etching to form the second nozzle portion is preferably isotropic dry etching.

This easily enables tapering.

In the nozzle plate manufacturing method according to the aspect of the invention, the dry etching to form the second nozzle portion is preferably anisotropic dry etching.

This makes it possible to readily form a cylindrical shape perpendicular to the plane of the silicon substrate.

A nozzle plate according to still another aspect of the invention is a nozzle plate manufactured by the manufacturing method according to the aspect of the invention.

In this way, the nozzle plate can be obtained that excels in protection against discharge liquid, and that has high nozzle-hole accuracy.

A droplet discharge head manufacturing method according to yet another aspect of the invention is a method for manufacturing a droplet discharge head that includes a nozzle plate having a plurality of nozzle holes through which droplets are discharged, a cavity substrate having a plurality of pressure chambers storing liquid and respectively in communication with the nozzle holes of the nozzle plate, and a pressure generator that causes a pressure change in the pressure chambers to discharge the liquid in droplets, the method including manufacturing the nozzle plate by the nozzle plate manufacturing method according to the aspect of the invention.

In this way, the droplet discharge head can be manufactured that excels in protection against discharge liquid, and that has stable ink discharge characteristics (discharge direction, discharge amount).

A droplet discharge head according to still yet another aspect of the invention is a droplet discharge head manufactured by the droplet discharge head manufacturing method according to the aspect of the invention.

In this way, a droplet discharge head can be manufactured that excels in protection against discharge liquid, and that has stable ink discharge characteristics (discharge direction, discharge amount).

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a droplet discharge head including a nozzle plate manufactured by a nozzle plate manufacturing method of an embodiment of the present invention is described below with reference to the accompanying drawings. As an example of a droplet discharge head, an inkjet head employing an electrostatic driving scheme will be described, with reference to FIG. 1 and FIG. 2. Note that the actuator (pressure generator) is not necessarily required to be of an electrostatic driving scheme, and other schemes using, for example, a piezoelectric element and a heater element may be used as well.

Figure 1:
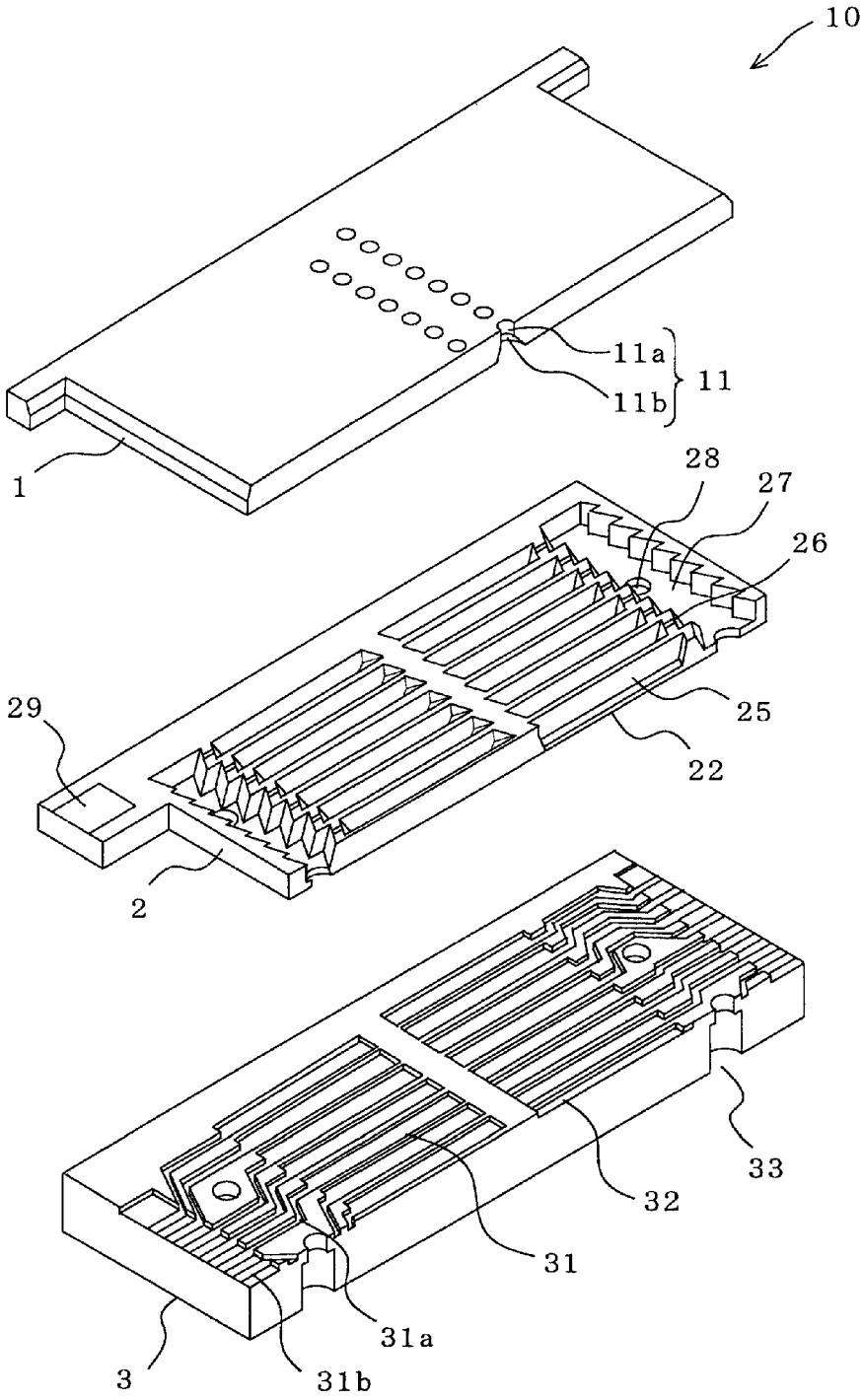
FIG. 1 is an exploded perspective view of an inkjet head that includes a nozzle plate of an embodiment of the present invention.
Figure 2:
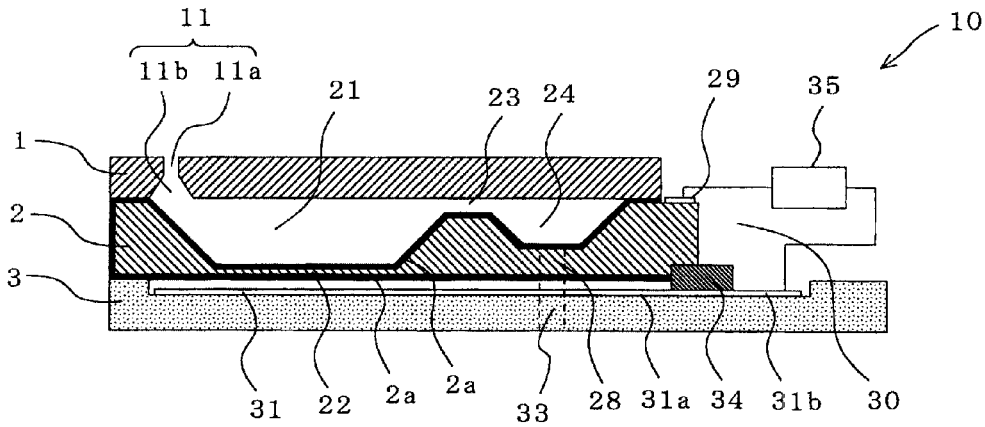
FIG. 2 is a schematic longitudinal sectional view of the inkjet head illustrated in FIG. 1.

FIG. 1 is an exploded perspective view schematically illustrating a disassembly structure of an inkjet head according to the present embodiment. Some elements are shown in a cross section. FIG. 2 is a cross sectional view schematically illustrating the structure in the right half portion of the inkjet head of FIG. 1. Note that FIG. 1 and FIG. 2 are shown upside down from the state during normal use.

As illustrated in FIG. 1 and FIG. 2, an inkjet head 10 of the present embodiment is structured from a nozzle plate 1 provided with a plurality of nozzle holes 11 formed with a predetermined pitch, a cavity plate 2 having ink supply channels independently provided for the nozzle holes 11, and an electrode substrate 3 provided with individual electrodes 31 disposed face to face with vibrating plates 22 of the cavity plate 2. The nozzle plate 1, the cavity plate 2, and the electrode substrate 3 are bonded together to form the inkjet head 10.

The nozzle plate 1 is fabricated from a silicon monocrystalline substrate (hereinafter, also referred to simply as "silicon substrate") having a thickness of, for example, 65 μm. The nozzle plate 1 includes a plurality of nozzle holes 11. Each nozzle hole 11 includes a cylindrical first nozzle portion 11*a* on the ink droplet discharge side, and a tapered, second nozzle portion 11*b* whose nozzle cross sectional area gradually increases from the first nozzle portion 11*a* backwards against the discharge direction. The first nozzle portion 11*a* is perpendicular to the surface of the nozzle plate 1, and the first nozzle portion 11*a* and the second nozzle portion 11*b* are concentric to each other. With the discharge direction of ink droplets aligned with the central axis of the nozzle holes 11, stable ink discharge characteristics can be obtained. Specifically, there will be no variation in the discharge direction of the ink droplets, and because the ink droplets do not spread, variation in the discharge amount of the ink droplets can be suppressed. Here, the second nozzle portion 11*b* on the supply side of ink droplets is described as being tapered; however, the invention is not limited to this, and the second nozzle portion 11*b* may be cylindrical in shape with a diameter greater than that of the first nozzle portion 11*a*.

Figure 3:
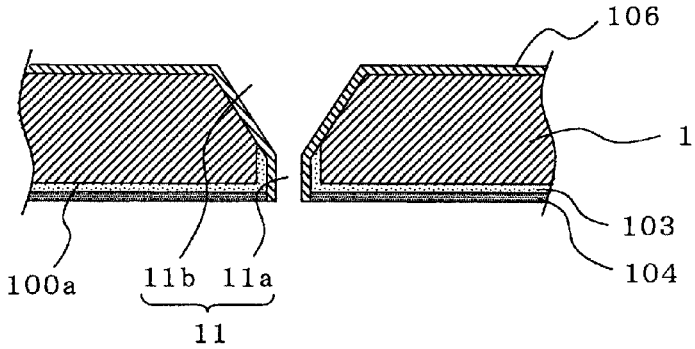
FIG. 3 is an enlarged view explaining a film structure of the nozzle plate illustrated in FIG. 1.

FIG. 3 is an enlarged view explaining the film structure of the nozzle plate 1 of FIG. 1. Note that the nozzle plate 1 illustrated in FIG. 3 is fabricated according to a first manufacturing method of the nozzle plate 1, as will be described later.

A liquid-resistant protective film 103 is formed on the inner walls of a discharge face 100*a* and the first nozzle portion 11*a* of the nozzle plate 1.

The liquid-resistant protective film 103 is formed on the discharge face 100*a* and on the inner wall of the first nozzle portion 11*a*. The liquid-resistant protective film 103 is formed on these faces in a single deposition step. The discharge face 100*a* also has a liquid repellent layer 104. A liquid-resistant protective film 106 is formed on the inner walls of the first nozzle portion 11*a* and the second nozzle portion 11*b*.

The nozzle plate 1 of the presently described exemplary embodiment is manufactured by the manufacturing methods described later, and has the film structure illustrated in FIG. 3. Accordingly, the nozzle plate 1 excels in protection against ink droplets and has high nozzle-hole accuracy. Further, variation in the diameter of the discharge openings of the nozzle holes 11 formed in the nozzle plate 1 can be suppressed to provide stable ink discharge characteristics (discharge direction, discharge amount).

The cavity plate 2 is fabricated from a silicon substrate. Wet etching of a silicon substrate forms recesses 25 that become ink-channel pressure chambers 21, recesses 26 that become orifices 23, and a recess 27 that becomes a reservoir 24. The recesses 25 are independently formed at positions corresponding to the nozzle holes 11. Accordingly, upon bonding of the nozzle plate 1 and the cavity plate 2 as in FIG. 2, the recesses 25 form the pressure chambers 21, and become in communication with the nozzle holes 11 and the orifices 23 formed as ink supply openings. The bottom walls of the pressure chambers 21 (recesses 25) define the vibrating plates 22.

The recesses 26 form the orifices 23 slit-like in shape, and the recesses 25 (pressure chambers 21) and the recess 27 (reservoir 24) are in communication with each other via the recesses 26.

The recess 27 is provided to store liquid material such as ink, and forms the reservoir (common ink chamber) 24 common to the pressure chambers 21. The reservoir 24 (recess 27) is in communication with all pressure chambers 21 via the orifices 23. The pressure chambers 21, the reservoir 24, and the orifices 23 together form ink channels. Note that the orifices 23 (recesses 26) may be formed on the back face of the nozzle plate 1 (the side bonded to the cavity plate 2). An ink supply opening 28 in communication with an ink supply opening 33 of the electrode substrate 3 (described later) is formed at the bottom of the reservoir 24. Ink is supplied from an ink cartridge (not illustrated) through the ink supply opening 33 and the ink supply opening 28.

An insulating film 2*a* of a material such as $SiO_2$ or TEOS (tetraethylorthosilicate, ethyl silicate) is formed in a thickness of 0.1 μm over the whole surface of the cavity plate 2, or at least on the opposing surface to the electrode substrate 3, using thermal oxidation or plasma CVD (Chemical Vapor Deposition). The insulating film 2*a* is formed to prevent insulation breakdown or shorting that may occur upon driving of the inkjet head 10.

The electrode substrate 3 is fabricated from a glass substrate having a thickness of, for example, about 1 mm. A borosilicate heat-resistant hard glass having a coefficient of thermal expansion close to that of the silicon substrate of the cavity plate 2 is suitably used. With similar coefficients of thermal expansion, the stress that occurs between the electrode substrate 3 and the cavity plate 2 during the anodic bonding of the two substrates can be reduced. Accordingly, the electrode substrate 3 and the cavity plate 2 can be strongly bonded to each other without problems such as detachment.

The electrode substrate 3 has recesses 32 at positions respectively corresponding to the vibrating plates 22 of the cavity plate 2 on the opposing side. The recesses 32 are formed by etching to a depth of about 0.3 μm. In each recess 32, the individual electrode 31 of generally ITO (Indium Tin Oxide) is formed by sputtering in a thickness of, for example, 0.1 μm. Thus, the gap formed between the vibrating plates 22 and the individual electrodes 31 are determined by the depth of the recesses 32, and the thicknesses of the individual electrodes 31 and the insulating film 2*a* covering the vibrating plates 22. This gap is formed with high accuracy because it greatly influences the discharge characteristics of the inkjet head 10.

Each individual electrode 31 has a lead portion 31*a*, and a terminal portion 31*b* connected to a flexible wiring board (not illustrated). As illustrated in FIG. 2, the terminal portion 31*b* is exposed to an electrode extracting portion 30 where the terminal portion of the cavity plate 2 appears for wiring.

The open end portion of the electrode gap formed between the vibrating plates 22 and the individual electrodes 31 is sealed with a sealant 34 such as an epoxy resin. This prevents entry of foreign materials such as moisture and dust into the electrode gap, maintaining the reliability of the inkjet head 10. A drive control circuit 35 such as an IC driver is connected to the terminal portion 31*b* of each individual electrode 31, and to a common electrode 29 provided on the cavity plate 2, via a flexible wiring board (not illustrated).

The operation of the inkjet head 10 configured as above is described below.

The drive control circuit 35 oscillates at, for example, 24 kHz to apply a pulse voltage between the common electrode terminal 29 of the cavity plate 2 and the individual electrodes 31 and to thereby supply charge to the individual electrodes 31. The individual electrodes 31 are positively charged by the supplied charge, and the vibrating plates 22 are negatively charged. As a result, an electrostatic force is generated between the vibrating plates 22 and the individual electrodes 31. The vacuum action of the electrostatic force attracts the vibrating plates 22 towards the individual electrodes 31, and thus bends the vibrating plates 22 as to increase the volume of the pressure chambers 21. As a result, the stored ink in the reservoir 24 flows into the pressure chambers 21 through the orifices 23. Cutting the voltage application to the individual electrodes 31 eliminates the electrostatic attraction force, and the volume of the pressure chambers 21 rapidly shrinks as the vibrating plates 22 restore the original shape. This causes an abrupt pressure increase in the pressure chambers 21, making the ink droplets discharge through the nozzle holes 11 in communication with the pressure chambers 21.

As described above, the inkjet head 10 of the present embodiment includes the nozzle plate 1 that has high nozzle-hole accuracy and stable ink discharge characteristics (discharge amount, discharge direction). Accordingly, variation in the discharge direction and discharge amount of ink droplets can be suppressed, and the ink droplets can be stably discharged with high spot position accuracy. In other words, high-resolution and high-quality printing can be realized.

A manufacturing method of the inkjet head 10 is described below with reference to FIGS. 4A to 4F to FIGS. 11E to 11H. FIGS. 4A to 4F to FIGS. 9L to 9Q are cross sectional views representing manufacturing steps of the nozzle plate 1. FIGS. 10A to 10D and FIGS. 11E to 11H are cross sectional views representing manufacturing steps of the cavity plate and the electrode substrate.

First, manufacturing methods of the nozzle plate 1 will be described. The nozzle plate 1, a feature of the invention, can be manufactured by two methods, as described below.

First Manufacturing Method of the Nozzle Plate 1

FIGS. 4A to 4F and FIGS. 5G to 5J represent a first manufacturing method of the nozzle plate. The first manufacturing method of the nozzle plate is now described with reference to these drawings.

(A) First, a silicon wafer (hereinafter, "silicon substrate 100") having a thickness of, for example, 725 μm is prepared. As a dry etching mask, a resist 101 is applied to a surface 100*a* of the silicon substrate 100. Then, the resist 101 is patterned by photolithography to form an opening 101*a* at a position corresponding to the first nozzle portion 11*a*. Note that the surface 100*a* eventually becomes the discharge face, and as such will be referred to as a discharge face 100*a*. Further, for simplicity, the manufacturing steps in FIGS. 4A to 4F to FIGS. 5G to 5J illustrate only one of the nozzle holes 11 formed in the silicon wafer.

(B) Then, by the anisotropic dry etching using an ICP dry etching device, the silicon substrate 100 is perpendicularly etched from the opening 101*a* of the resist 101 to form a depression 102 that becomes the first nozzle portion 11*a*.

Here, for example, $C_4F_8$ and $SF_6$ can be used as the etching gas, and these can be used alternately. The $C_4F_8$ is used to protect the side faces of the first nozzle portion 11*a* by preventing etching toward the sides of the depression 102. The $SF_6$ is used to promote etching perpendicular to the silicon substrate 100. Here, the alternate etching is 2 seconds with $C_4F_8$, and 3.5 seconds with $SF_6$.

(C) The resist pattern 101 is detached by, for example, washing with sulfuric acid.

(D) A liquid-resistant protective film 103 having ink resistance is formed over the whole surface of the silicon substrate 100 (including the inner wall of the depression 102 to be the first nozzle portion 11*a*). In the presently described embodiment, the silicon substrate 100 is placed in a thermal oxidation furnace, and a thermal oxidation film ($SiO_2$ film) having a thickness of, for example, 0.1 μm is formed over the whole surface of the silicon substrate 100 (including the inner wall of the depression 102 to be the first nozzle portion 11*a*). Then, the whole surface of the silicon substrate 100 (including the inner wall of the depression 102 to be the first nozzle portion 11*a*) is subjected to a liquid repellent treatment performed to impart ink repellency. Specifically, a liquid repellent material of primarily a silicon compound containing a fluorine atom is deposited by vapor deposition or dipping to form a liquid repellent layer 104. The liquid repellent layer 104 is also formed on the inner wall of the depression 102 to be the first nozzle portion 11*a*.

(E) A support substrate 110 made of a transparent material such as glass is attached to the discharge face 100*a* of the silicon substrate 100 via a double-sided adhesive sheet 50. Specifically, the silicon substrate 100 and the support substrate 110 are attached to each other in a vacuum with the silicon substrate 100 facing a self detaching layer 51 of the double-sided adhesive sheet 50 attached to the support substrate 110. This enables clean bonding without leaving air bubbles at the bond interface. Residual air bubbles at the bond interface after the bonding causes thickness variation in reducing the thickness of the silicon substrate 100 in the next grinding process (F).

As the double-sided adhesive sheet 50, Selfa BG® (Sekisui Chemical Co., Ltd.) is used, for example. The double-sided adhesive sheet 50 is a sheet with the self detaching layer 51 (self detaching sheet). It has adhesive faces on the both sides, and further includes the self detaching layer 51 on one of the surfaces. The self detaching layer 51 is designed so that its adherence weakens in response to stimuli such as ultraviolet rays and heat. Because the bonding to the support substrate 110 is made using the double-sided adhesive sheet 50 having the self detaching layer 51, the thickness reduction of the silicon substrate 100 can be made with the silicon substrate 100 firmly attached to the support substrate 110 and thus without damaging the silicon substrate 100.

Further, as will be described later, the support substrate 110 can easily be detached from the silicon substrate 100 after the grinding process, without leaving adhesives.

Then, the silicon substrate 100 is reduced to a desired thickness by a grinding process, using a grinder (not illustrated) from the surface 100*b* side of the silicon substrate 100 opposite from the discharge face 100*a*.

In contrast to the manufacturing method of the related art having the problem of chipping at the periphery of the discharge opening during the thickness reduction (grinding process), the manufacturing method of the presently described embodiment performs the grinding process on the opposite side from the depression 102 formed in advance to provide the first nozzle portion 11*a* having an discharge opening. Further, because the second nozzle portion 11*b* is formed after the grinding process in the manner described below, chipping does not occur in either the first nozzle portion 11*a* or the second nozzle portion 11*b*. This improves the yield.

(F) A resist 105 is applied on the surface 100*b* of the silicon substrate 100. The resist 105 is then patterned by photolithography to form an opening 105*a* at a position corresponding to the second nozzle portion 11*b*.

(G) By the isotropic dry etching using an ICP dry etching device, the silicon substrate 100 is etched from the opening 105*a* of the resist 105 to form the second nozzle portion 11*b* of a tapered shape. The second nozzle portion 11*b* is in communication with the first nozzle portion 11*a* to form the nozzle hole 11. Note that the isotropic dry etching has the advantage of easily enabling tapering, but poses difficulties in dimensional control. The presently described embodiment takes advantage of the tapering advantage of isotropic dry etching because the second nozzle portion 11*b* does not require high levels of dimensional accuracy. The inner wall of the first nozzle portion 11*a* is protected from etching by the liquid-resistant protective film ($SiO_2$ film) 103 that also serves as an etching mask. Thus, the dry etching to form the second nozzle portion 11*b* does not etch the first nozzle portion 11*a*. The tapering of the second nozzle portion 11*b* is preferable because it advantageously reduces the channel resistance more than in a cylindrical shape. However, as mentioned above, the shape of the second nozzle portion 11*b* is not limited to a taper, and may be cylindrical with a larger diameter than the first nozzle portion 11*a*. When the second nozzle portion 11*b* is shaped into a cylinder, the silicon substrate 100 is perpendicularly etched by anisotropic dry etching as in the first nozzle portion 11*a*.

(H) The resist pattern 105 is etched by, for example, washing with sulfuric acid. Then, Ar sputtering or an $O_2$ plasma treatment is performed to remove the liquid-resistant protective film 103 and the liquid repellent layer 104 projecting into the second nozzle portion 11*b* and remaining at the bottom of the depression that becomes the first nozzle portion 11*a*. Here, the liquid repellent layer 104 remaining on the inner wall of the first nozzle portion 11*a* is also removed.

(I) Next, a liquid-resistant protective film 106 having ink resistance is formed on the surface 100*b* of the silicon substrate 100. The liquid-resistant protective film 106 is formed of, for example, tantalum (V) oxide by CVD (Chemical Vapor Deposition). Other than tantalum (V) oxide, the liquid-resistant protective film 106 may be formed of, for example, hafnium oxide, titanium oxide, indium tin oxide, or zirconium oxide. The deposition of the liquid-resistant protective film 106 is not limited to CVD, and may be made by, for example, sputtering, as long as it is performed at temperatures that do not degrade the self detaching layer 51 (about 100° C. or less).

(J) Then, UV light is shone from the support substrate 110 side to foam the self detaching layer 51 of the double-sided adhesive sheet 50 and to thereby detach the support substrate 110 from the discharge face 100*a* of the silicon substrate 100.

This completes the fabrication of the nozzle plate 1. Note that, when forming the nozzle holes 11 in the silicon substrate 100, perforating grooves are formed on the silicon substrate 100 along the portions defining the nozzle chips, though not illustrated. This enables the nozzle plate 1 to be divided into individual pieces when the support substrate 110 is detached in step (J).

The first manufacturing method of the nozzle plate 1 described above is advantageous in the following respects:

(1a) Because the liquid-resistant protective film 103 is formed over the whole surface of the silicon substrate 100 after forming the depression 102 in the silicon substrate 100 to form the first nozzle portion 11*a*, the liquid-resistant protective film 103 can be continuously formed without any boundary between the inner wall of the first nozzle portion 11*a* and the discharge face 100*a*. This solves the problem of damage to the discharge opening due to ink corrosion that occurs in the method of the related art in which the liquid-resistant protective films are separately formed on the inner wall of the nozzle hole and on the discharge face in different steps. As a result, nozzle-hole accuracy can be improved.

Figure 4A:
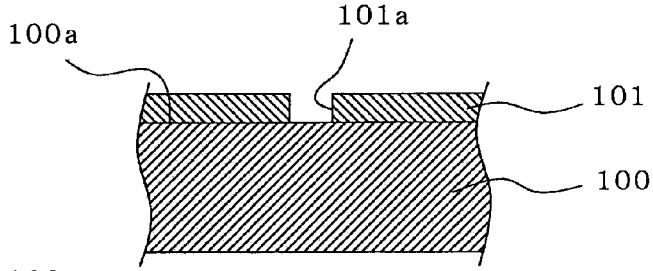
FIGS. 4A to 4F are cross sectional views representing manufacturing steps of a first manufacturing method of the nozzle plate.
Figure 4B:
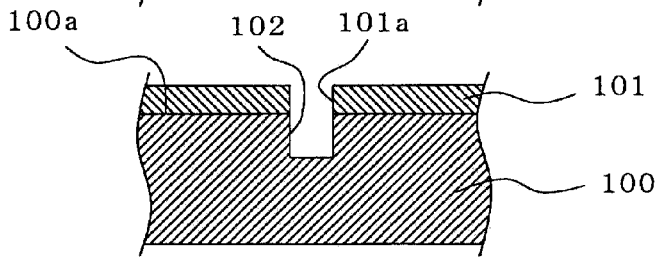
Figure 4C:
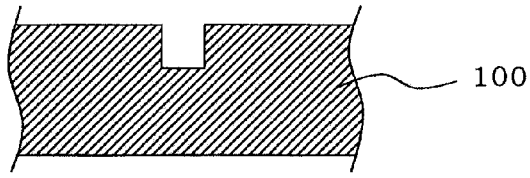
Figure 4D:
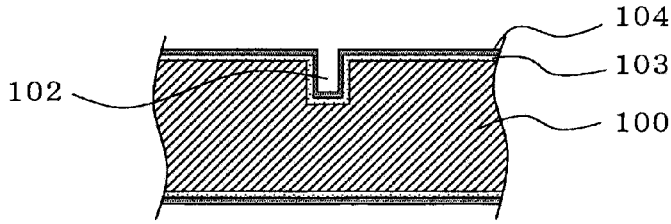
Figure 4E:
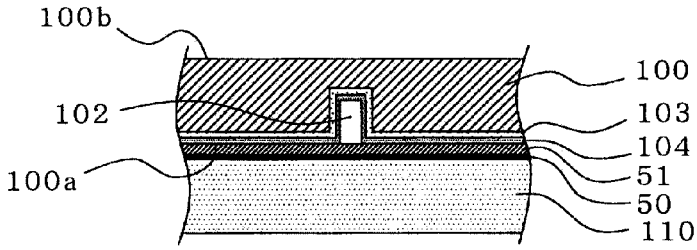
Figure 4F:
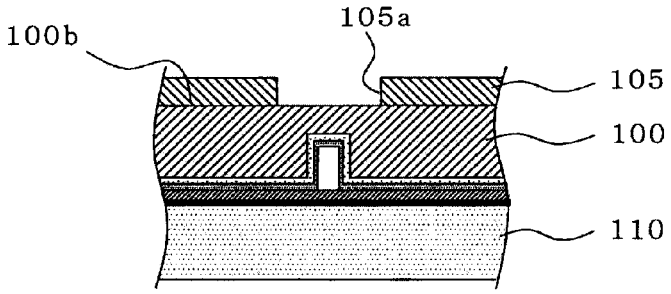
Figure 5G:
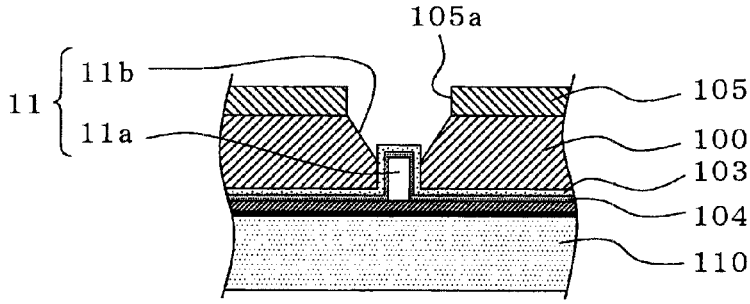
FIGS. 5G to 5J are cross sectional views representing nozzle plate manufacturing steps continuing from FIGS. 4A to 4F.
Figure 5H:
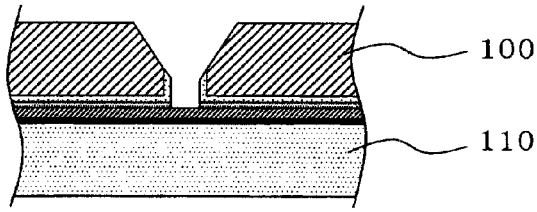
Figure 5I:
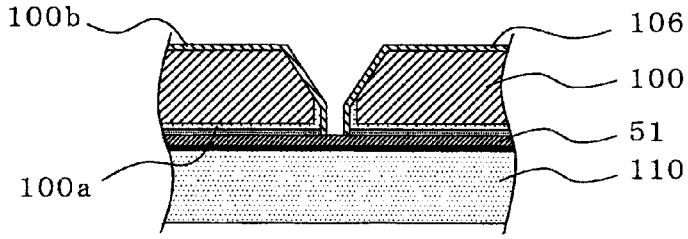
Figure 5J:
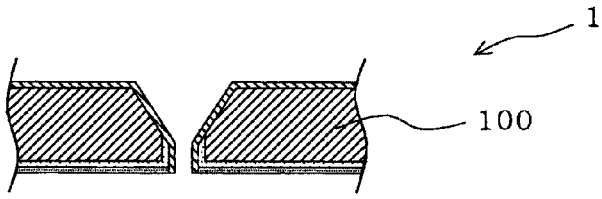

(1b) Because the liquid-resistant protective film 103 is formed on the silicon substrate 100 before reducing the thickness of the silicon substrate 100, no support substrate is required in the step of forming the liquid-resistant protective film 103 (FIG. 4D). When a support substrate is used, it prevents high-temperature treatment for reasons of the heat resistance of the adhesive sheet used for the support substrate, and the heat resistance of the support substrate itself. This necessitates the liquid-resistant protective film 103 to be formed as, for example, a $SiO_2$ film using methods, such as CVD, that allow for low-temperature deposition. However, because CVD does not allow formation of a dense $SiO_2$ film, the thickness is inevitably increased when necessary protection against ink is to be obtained. This affects the dimensional accuracy of the nozzle holes, which leads to variation in nozzle hole diameter. In contrast, with no support substrate, the present embodiment enables the silicon substrate 100 to be placed in a high-temperature (about 700° C. to 1,000° C.) thermal oxidation furnace, and a thermal oxidation film to be formed as the liquid-resistant protective film 103. The thermal oxidation film is a dense, uniform film with high thickness controllability, and thus offers sufficient protection with a thickness about 1/10 of the $SiO_2$ film formed by CVD. This makes it possible to form the nozzle holes 11 with high accuracy, and suppress variation in nozzle hole diameter.

(1c) Because the second nozzle portion 11*b* is formed after the grinding process (thickness reduction) performed on the opposite side from the depression 102 formed in advance to provide the first nozzle portion 11*a* having a discharge opening, no chipping occurs in either the first nozzle portion 11*a* or the second nozzle portion 11*b*. This improves the yield.

(1d) Because the resist (dry etching mask) 101 patterned surface becomes the discharge face 100*a* (FIG. 4B), the nozzle diameter accuracy can be improved far greater than in the method of the related art in which the etching proceeds deep down towards the surface that becomes the discharge face. This makes it possible to provide a uniform shape or uniform dimensions for the discharge opening of each nozzle hole 11 formed through the nozzle plate 1, thus providing uniform discharge characteristics for the ink droplets.

(1e) Because the second nozzle portion 11*b* is formed by isotropic dry etching, the second nozzle portion 11*b* can be easily tapered. Thus, the channel resistance can be reduced more than when the second nozzle portion 11*b* is formed into a cylinder, and the discharge performance (for example, the straightness of the discharge direction) can be improved. As mentioned above, the shape of the second nozzle portion 11*b* is not limited to a taper, and may be cylindrical. When the second nozzle portion 11*b* is formed into a cylinder, anisotropic dry etching is used as in the first nozzle portion 11*a*. Anisotropic dry etching readily enables formation of a cylinder perpendicular to the plane of the silicon substrate, and improves the discharge performance (for example, the straightness of the discharge direction) compared with when the nozzle holes 11 are entirely formed into a cylinder without any step.

(1f) In the method of the related art, the plasma treatment to remove the excess liquid repellent layer on the inner wall of the nozzle holes is performed on the opposite side from the discharge face, after attaching a support tape to the discharge face and detaching the support substrate from the opposite side of the discharge face. Specifically, the support member needs to be reattached to the discharge face from the other surface; in other words, the support member needs to be attached twice. In contrast, in the presently described embodiment, the support substrate 110 is attached to the discharge face 100*a* side (FIG. 4E) after successively forming the liquid-resistant protective film 103 and the liquid repellent layer 104 on the discharge face 100*a* side, including the inner wall of the depression 102 formed in advance in the silicon substrate 100 to provide the first nozzle portion 11*a*. The all other subsequent treatments and processes are performed from the surface 100*b* side. Because the support member does not need to be reattached to the silicon substrate 100, only a single attaching step is required for the support member, making it possible to simplify the manufacturing method of the related art JP-A-2007-168344. Further, the possibility of foreign objects, such as the adhesive used for the bonding of the support member, remaining on the silicon substrate 100 can be reduced.

Second Manufacturing Method of Nozzle Plate 1

The second manufacturing method of the nozzle plate 1 further simplifies the manufacturing steps by eliminating the need for the support substrate 110 used in the first manufacturing method of the nozzle plate 1.

FIGS. 6A to 6E to FIGS. 9L to 9Q are drawings representing the second manufacturing method of the nozzle plate. The second manufacturing method of the nozzle plate is now described with reference to FIGS. 6A to 6E to FIGS. 9L to 9Q. Note that, in FIGS. 6A to 6E to FIGS. 9L to 9Q, similar elements or features may have the same reference numerals used in the description of the first manufacturing method of the nozzle plate represented in FIGS. 4A to 4F. Further, for simplicity, the manufacturing steps in FIGS. 6A to 6E to FIGS. 9L to 9Q illustrate only one of the nozzle holes 11 formed in the silicon wafer.

The steps (A) to (C) are the same as the steps (A) to (C) of the first manufacturing method of the nozzle plate 1 represented in FIGS. 4A to 4F. For example, a depression 102 to be the first nozzle portion 11*a* is formed in a silicon wafer having a thickness of 725 μm (hereinafter, "silicon substrate 100").

(D) Then, an oxide film ($SiO_2$ film) 120 that serves as a dry etching mask in a later step is formed over the whole surface of the silicon substrate 100 (including the inner wall of the depression 102 to be the first nozzle portion 11*a*).

(E) The thickness of the silicon substrate 100 is reduced to a desired thickness from a surface 100*b* opposite from the surface 100*a* (hereinafter, "discharge face 100*a*") of the silicon substrate 100 where the depression 102 for the first nozzle portion 11*a* is formed. The thickness is reduced not over the whole surface of the silicon substrate 100, but over at least the regions where the nozzle holes are formed. In the presently described embodiment, the thickness is reduced only in the regions of the nozzle holes, leaving the peripheral portions. As a result, a depression 121 is formed in the silicon substrate 100.

Figure 6A:
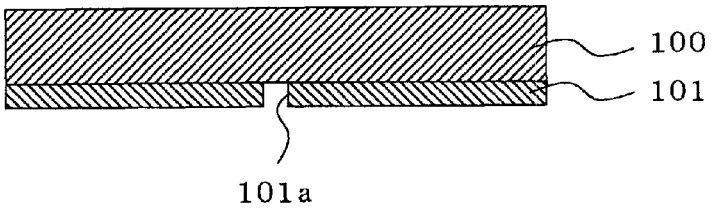
FIGS. 6A to 6E are cross sectional views representing manufacturing steps of a second manufacturing method of the nozzle plate.
Figure 6B:
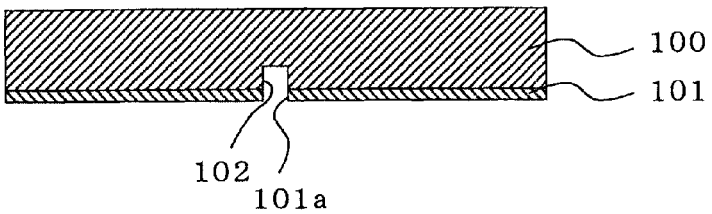
Figure 6C:
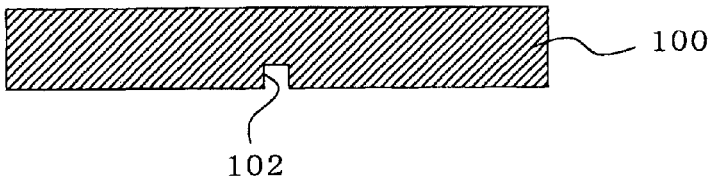
Figure 6D:
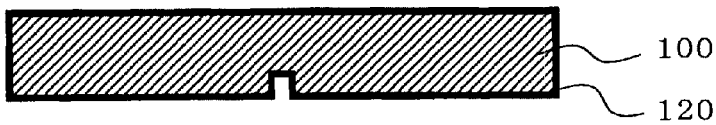
Figure 6E:
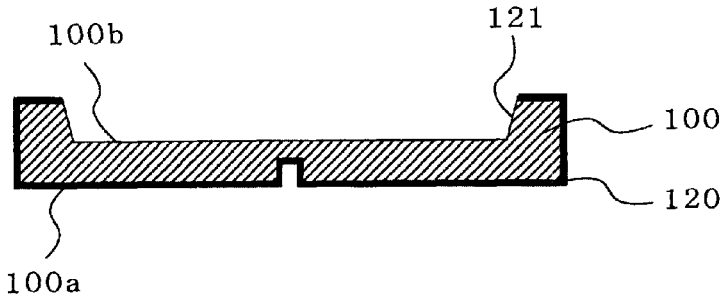
Figure 7A:
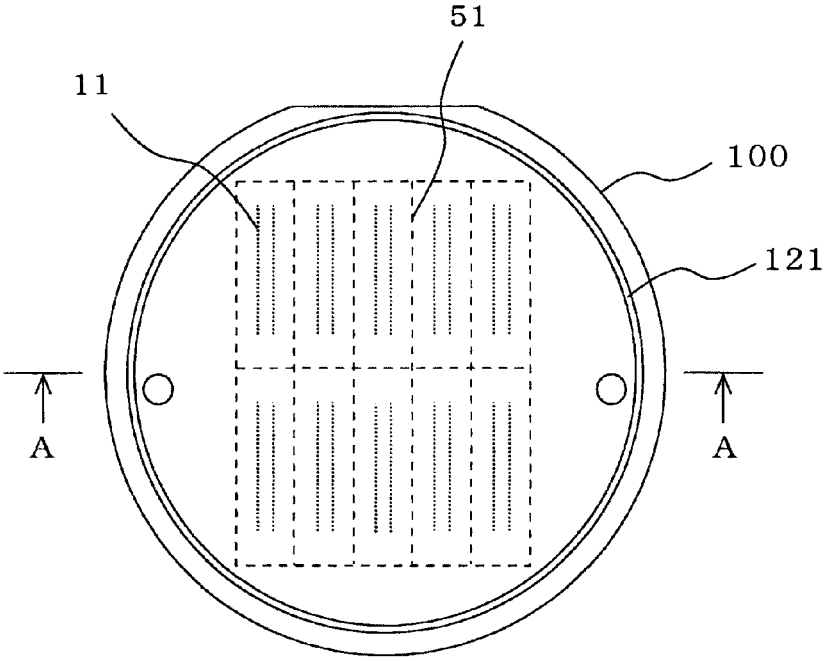
FIGS. 7A and 7B are explanatory drawing illustrating the silicon substrate of FIG. 6E.
Figure 7B:
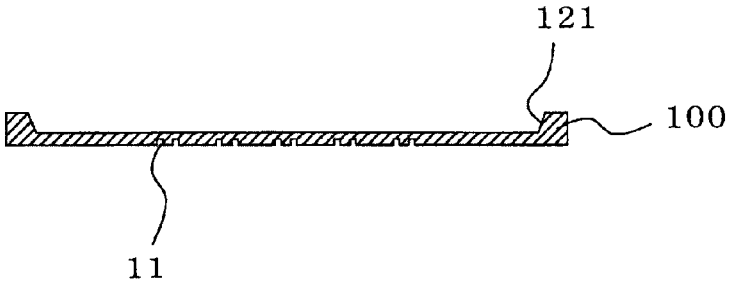

FIGS. 7A and 7B are detailed views of FIG. 6E. FIG. 7A is a plan view of the silicon substrate 100. FIG. 7B is a cross sectional view of FIG. 7A at A-A. Note that the dotted lines in FIG. 7A are shown for reference to indicate the dicing lines used for the dicing performed at the last stage of manufacture. Further, in FIG. 7B, the oxide film 120 is not shown.

As illustrated in FIGS. 7A and 7B, by reducing the thickness of the silicon substrate 100 only in the regions of the nozzle holes but not in the peripheral portions, the silicon substrate 100 can remain strong enough to be carried alone, even with the reduced thickness. Thus, the silicon substrate 100 can be sent to the subsequent manufacturing steps on its own, without using a support substrate.

Figure 8F:
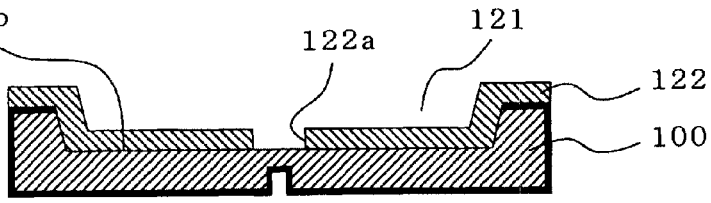
FIGS. 8F to 8K are cross sectional views representing nozzle plate manufacturing steps continuing from FIGS. 6A to 6E.
Figure 8G:
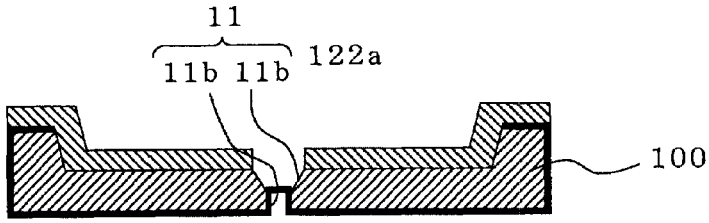
Figure 8H:
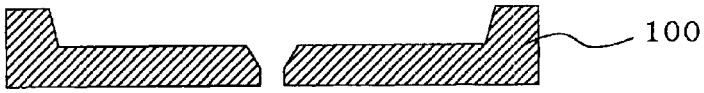
Figure 8I:
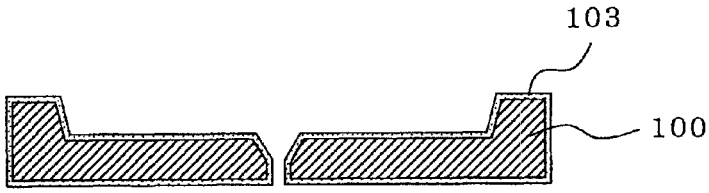
Figure 8J:
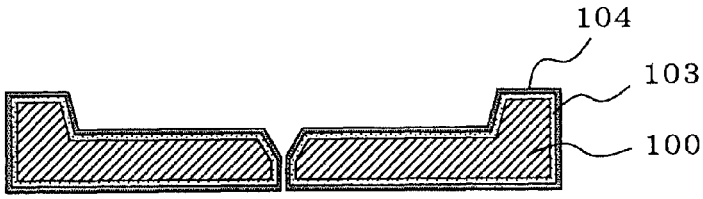
Figure 8K:
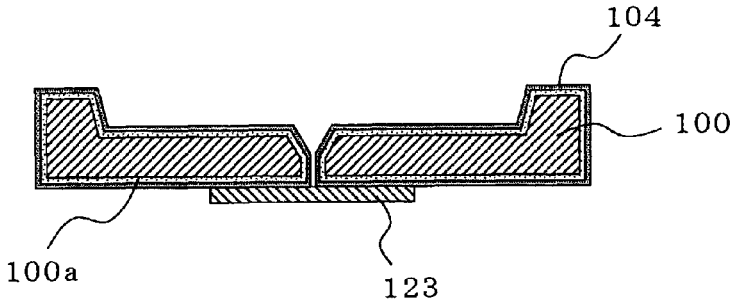

(F) Next, as illustrated in FIG. 8F, a resist 122 is applied to the surface 100*b* on the depression 121 side of the silicon substrate 100. The resist 122 is then patterned by photolithography to form an opening 122*a* at a position corresponding to the second nozzle portion 11*b*.

(G) By the isotropic dry etching using an ICP dry etching device, the silicon substrate 100 is etched from the opening 122*a* of the resist 122 to form the second nozzle portion 11*b* of a tapered shape. The second nozzle portion 11*b* is in communication with the first nozzle portion 11*a* to form the nozzle hole 11.

(H) The resist pattern 122 and the oxide film 120 are detached by, for example, washing with sulfuric acid.

(I) Then, the liquid-resistant protective film 103 having ink resistance is formed over the whole surface of the silicon substrate 100 (including the inner wall of the nozzle portion 11). In the presently described embodiment, the silicon substrate 100 is placed in a thermal oxidation furnace, and a thermal oxidation film ($SiO_2$ film) having a thickness of, for example, 0.1 μm is formed over the whole surface of the silicon substrate 100 (including the inner wall of the depression 102 to be the first nozzle portion 11*a*). This is followed by washing of the silicon substrate 100. The washing desirably cleans the inner side of the nozzle holes 11, because the nozzle holes 11 are not closed by other components such as the support substrate and are thus open on the both sides.

(J) Then, a liquid repellent treatment is performed to impart liquid repellency against the discharge liquid (ink in this example). Specifically, a liquid repellent material of primarily a silicon compound containing a fluorine atom is deposited by vapor deposition or dipping to form a liquid repellent layer 104 over the whole surface of the silicon substrate 100. The liquid repellent layer 104 is also formed on the inner wall of the nozzle holes 11.

(K) Then, a protective tape 123 is attached to the discharge face 100*a* of the silicon substrate 100 in portions where liquid repellency needs to remain, specifically, around the discharge openings of the nozzle holes 11.

Figure 9L:
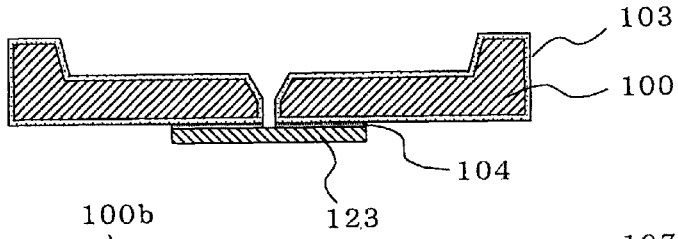
FIGS. 9L to 9Q are cross sectional views representing nozzle plate manufacturing steps continuing from FIGS. 8F to 8K.
Figure 9M:
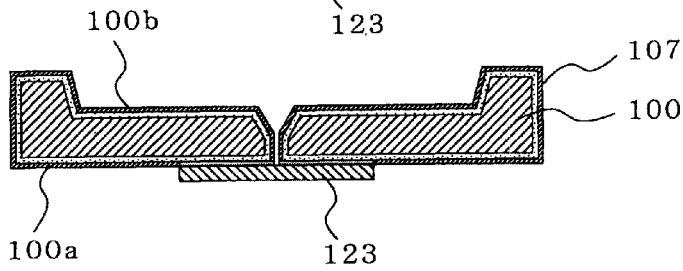
Figure 9N:
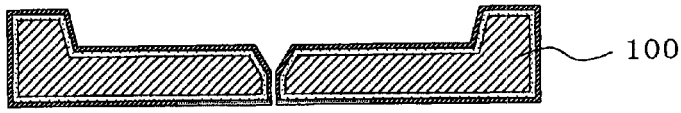
Figure 9O:
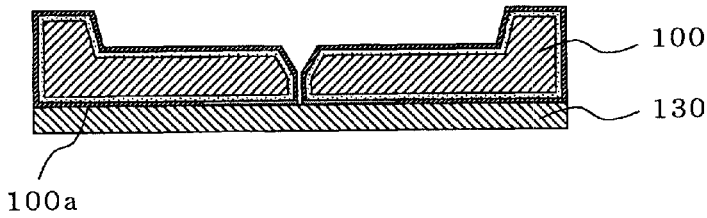
Figure 9P:
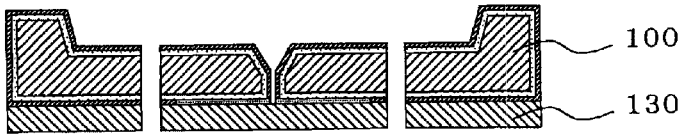
Figure 9Q:
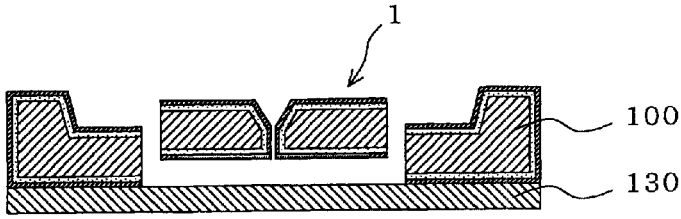

(L) As illustrated in FIG. 9L, the liquid repellent layer 104 is removed by Ar sputtering or $O_2$ plasma treatment except in portions protected by the protective tape 123. It is not preferable to perform the liquid repellent treatment in portions other than the areas around the discharge openings of the nozzle holes 11 on the discharge face 100*a*, because these portions are eventually bonded to ahead cover (not illustrated) during the assembly into an inkjet head and thus require adhesion for an adhesive. The liquid repellent layer 104 is thus removed from these portions.

(M) The surface 100*b* opposite from the discharge face 100*a* of the silicon substrate 100 is bonded to the cavity plate 2, and thus a primer layer 107 is formed thereon to improve bondability to the cavity plate 2. Note that the primer layer 107 is formed over the whole surfaces of the silicon substrate 100 for reasons associated with the manufacturing step. However, this is not necessarily required as long as the primer layer 107 is formed on the silicon substrate 100 on the surface bonded to the cavity plate 2.

(N) The protective tape 123 is detached.

(O) A dicing tape 130 is attached to the discharge face 100*a* side of the silicon substrate 100.

(P) The silicon substrate 100 is diced into individual nozzle chips.

(Q) The individual nozzle chips are detached from the dicing tape 130 to complete the nozzle plate 1.

The second manufacturing method of the nozzle plate 1 described above has the same advantages (1a) to (1e) as the first manufacturing method of the nozzle plate 1. The second manufacturing method additionally has the following advantages.

(2a) Because the thickness of the silicon substrate 100 is reduced in the regions of the nozzle holes but not in the peripheral portions in the thickness reducing step to adjust the nozzle length (FIG. 6E), the silicon substrate 100 can remain strong enough to be carried alone without a support substrate. Thus, the support substrate is not required in any of the steps in the fabrication of the nozzle plate 1. This further simplifies the manufacturing steps. Further, because the support substrate is not required, the problem of foreign objects, such as the adhesive used to attach the support substrate, remaining on the silicon substrate 100 can be prevented.

(2b) Because the manufacturing method does not require a support substrate, the nozzle holes 11 are not closed by members such as the support substrate and remain open to enable the inner side of the nozzle holes 11 to be washed in a desirable manner.

The invention has been described with respect to certain embodiments of a manufacturing method of the nozzle plate 1, which is a feature of the invention. The following describes a manufacturing method of the cavity plate 2 and the electrode substrate 3.

Manufacturing Method of Cavity Plate 2 and Electrode Substrate 3

A method of manufacturing the cavity plate 2 is described below in which the cavity plate 2 is fabricated from a silicon substrate 200 bonded to the electrode substrate 3, with reference to FIGS. 10A to 10D and FIGS. 11E to 11H.

The electrode substrate 3 is manufactured as follows.

(A) First, the recesses 32 are formed by hydrofluoric acid etching of an about 1 mm-thick glass substrate 300 of, for example, borosilicate glass, using, for example, a gold-chromium etching mask. The recesses 32 are slit-like in shape and slightly larger than the individual electrodes 31, and are provided to respectively correspond to the individual electrodes 31.

Then, the individual electrodes 31 are formed inside the recesses 32 by, for example, sputtering, using ITO (Indium Tin Oxide).

The fabrication of the electrode substrate 3 is completed after forming the ink supply opening 33 using methods such as drilling.

(B) Then, the both surfaces of a silicon substrate 200 having a thickness of, for example, 525 μm are polished to mirror finish, and a $SiO_2$ film (insulating film) 2*a* having a thickness of 0.1 μm is formed on one of the surfaces of the silicon substrate 200 by plasma CVD. Prior to forming the silicon substrate 200, a boron doped layer may be formed that allows the thickness of the vibrating plates 22 to be accurately controlled using an etching stop technique. The "etching stop" is defined as the state in which air bubbles have stopped being generated from the etching face. In actual wet etching, the etching is considered stopped when the air bubbles stop being generated.

Figure 10A:
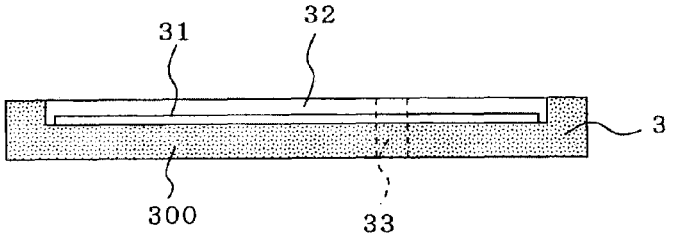
FIGS. 10A to 10D are cross sectional views representing inkjet head manufacturing steps continuing from FIGS. 9L to 9Q.
Figure 10B:
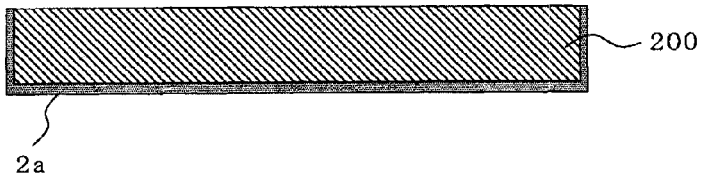
Figure 10C:
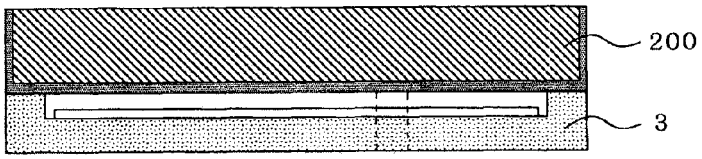
Figure 10D:
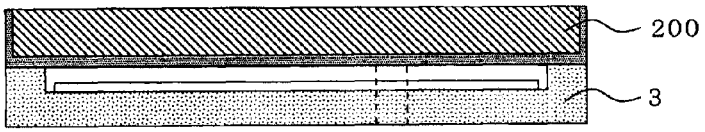
Figure 11E:
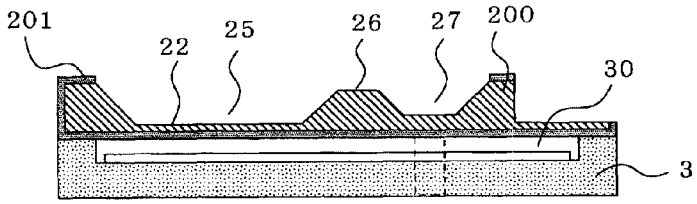
FIGS. 11E to 11H are cross sectional views representing inkjet head manufacturing steps continuing from FIGS. 10A to 10D.
Figure 11F:
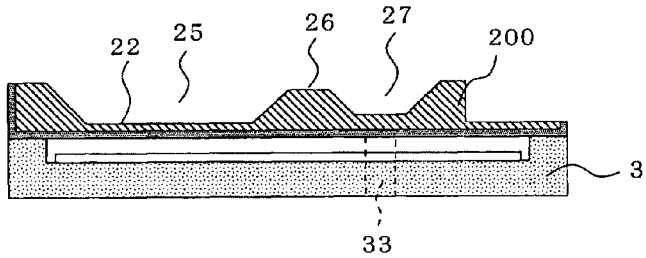
Figure 11G:
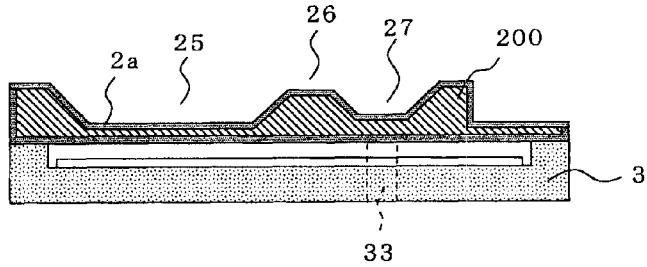
Figure 11H:
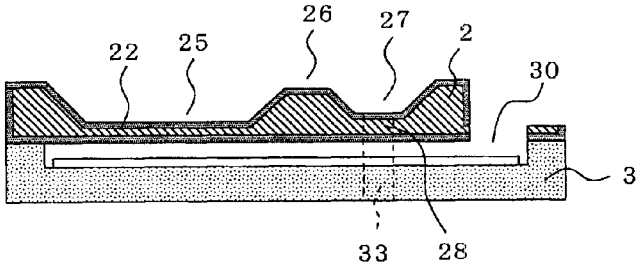

(C) The silicon substrate 200 and the electrode substrate 3 fabricated as in FIG. 10A are heated to, for example 360° C., and a voltage of about 800 V is applied between the silicon substrate 200 and the electrode substrate 3 connected to an anode and a cathode, respectively, so as to anodically bond the two substrates.

(D) After the anodic bonding of the silicon substrate 200 and the electrode substrate 3, the silicon substrate 200 bonded to the electrode substrate 3 is etched with, for example, a potassium hydroxide aqueous solution, so as to reduce the thickness to, for example, 140 μm.

(E) Then, a TEOS film 201 having a thickness of, for example, 1.5 μm is formed by plasma CVD over the whole upper surface of the silicon substrate 200 on the opposite side from the electrode substrate 3.

The TEOS film 201 is patterned with a resist used to form the recesses 25 and 27 that become the pressure chambers 21 and the reservoir 24, respectively. The TEOS film 201 in these portions is then removed by etching.

This is followed by etching of the silicon substrate 200 using, for example, a potassium hydroxide aqueous solution to form the recesses 25 and 27 that become the pressure chambers 21 and the reservoir 24, respectively. Here, the portion to be the electrode extracting portion 30 for wiring is also etched to reduce the thickness. In the wet etching step represented in FIG. 11E, the etching may be performed first with, for example, a 35 weight % potassium hydroxide aqueous solution, and then with, for example, a 3 weight % potassium hydroxide aqueous solution. In this way, surface deterioration of the vibrating plates 22 can be suppressed.

(F) After the etching of the silicon substrate 200, the silicon substrate 200 is etched with a hydrofluoric acid aqueous solution to remove the TEOS film 201 formed on the upper surface of the silicon substrate 200.

(G) Then, a $SiO_2$ film (insulating film 2*a*) having a thickness of, for example, 0.1 μm is formed by plasma CVD on the silicon substrate 200 on the side of the elements such as the recesses 25 that become the pressure chambers 21.

(H) Then, the electrode extracting portion 30 is opened by RIE (Reactive Ion Etching) or the like. Further, the ink supply opening 28 is formed through the bottom of the silicon substrate 200 in the recess 27 that becomes the reservoir 24, using a laser through the ink supply opening 33 of the electrode substrate 3. The open end of the gap between the vibrating plates 22 and the individual electrodes 31 is sealed with the sealant 34 (see FIG. 2) such as an epoxy resin. Further, as illustrated in FIG. 1 and FIG. 2, the common electrode 29 is formed by sputtering at an end portion on the upper surface of the silicon substrate 200 (on the side bonded to the nozzle plate 1).

The cavity plate 2 is fabricated in the described manner from the silicon substrate 200 bonded to the electrode substrate 3.

Finally, the nozzle plate 1 fabricated as above is bonded to the cavity plate 2 using an adhesive. Here, the nozzle plate 1 is bonded to the cavity plate 2 on the primer layer 107 side. Thus, the nozzle plate 1 and the cavity plate 2 are bonded to each other with good bondability.

This completes the fabrication of the main body portion of the inkjet head 10 illustrated in FIG. 2.

The inkjet head 10 fabricated as above includes the nozzle plate 1 manufactured by the foregoing manufacturing method, and therefore excels in durability (protection) against ink droplets, and exhibits stable ink discharge characteristics (discharge direction, discharge amount).

The manufacturing method of the nozzle plate 1 according to an embodiment of the invention has been described based on a nozzle plate used for the inkjet head of an electrostatic driving scheme. However, the invention is also applicable to a nozzle plate used for the inkjet head that uses an actuator (pressure generator) of other schemes such as a piezoelectric driving scheme and a Bubble Jet® scheme.

The invention has been described with respect to certain embodiments of a manufacturing method of a nozzle plate for the inkjet head of a three-layer structure including the nozzle plate 1, the cavity plate 2, and the electrode substrate 3. However, the invention is also applicable as a manufacturing method of a nozzle plate for the inkjet head of a four-layer structure including a nozzle plate, a reservoir substrate, a cavity plate, and an electrode substrate.

Figure 12:
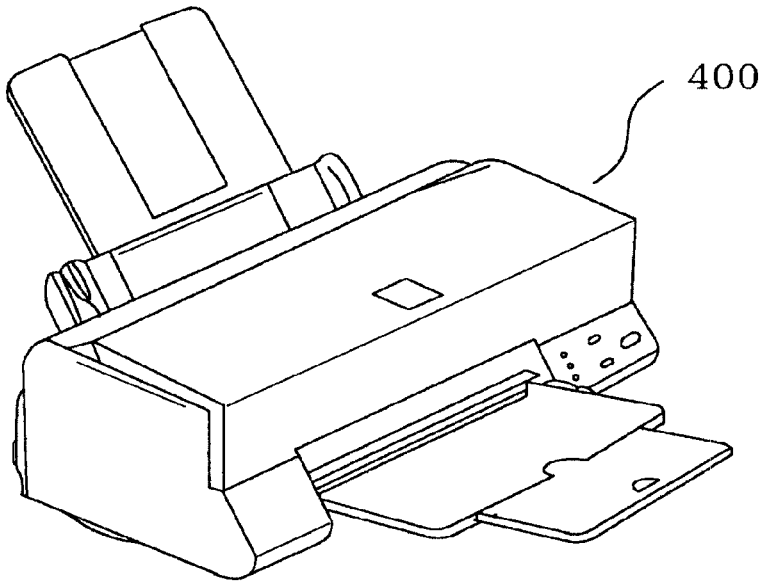
FIG. 12 is a perspective view of an inkjet printer using an inkjet head of an embodiment of the invention.

Further, the invention has been described with respect to certain embodiments of the structure and manufacturing method of the nozzle plate 1, the inkjet head, and the manufacturing method of the inkjet head. However, the invention is not limited by these embodiments, and thus variations that do not depart from the substance of the invention are intended to be within the scope of the invention. For example, changing the liquid material discharged through the nozzle holes 11 makes the invention applicable to a wide variety of droplet discharge apparatuses and related applications, including an inkjet printer 400 as illustrated in FIG. 12, manufacture of color filters for liquid crystal displays, formation of emissive parts in organic EL displays, formation of wiring in wiring boards manufactured with a printed wiring board manufacturing apparatus, and discharge of biological droplets (such as in manufacture of a protein chip and a DNA chip).

What is claimed is:

1. A method for manufacturing a plate, the method comprising:

forming a first etching mask on a first surface of a silicon substrate;

forming a first depression in the first surface of the silicon substrate by a first etching;

removing the first etching mask;

forming a first liquid-resistant protective film on the silicon substrate, the first liquid-resistant protective film having liquid resistance;

bonding a support substrate to the first surface of the silicon substrate, the support substrate supporting the silicon substrate;

reducing the silicon substrate to a desired thickness from a second surface side opposite to the first surface;

forming a second etching mask on the second surface of the silicon substrate;

forming a second depression in the second surface of the silicon substrate by a second etching; and detaching the support substrate from the silicon substrate.

2. The method according to claim 1, further comprising:

forming a liquid repellent layer on the first liquid-resistant protective film, the liquid repellent layer having liquid repellency, and removing a part of the first liquid-resistant protective film and a part of the liquid repellent layer.

3. The method according to claim 2, further comprising:

forming a second liquid-resistant protective film on the silicon substrate, the second liquid-resistant protective film having liquid resistance.

4. The method according to claim 1, wherein a thickness of the silicon substrate is reduced by grinding.

5. The method according to claim 1, wherein the first depression and the second depression are formed by dry etching.

6. The method according to claim 1, wherein the second depression is formed by isotropic dry etching.

7. The method according to claim 1, wherein the second depression is formed by anisotropic dry etching.

8. The method according to claim 1, wherein an open area of the second depression is larger than an open area of the first depression.

9. The method according to claim 1, wherein a cross sectional area of the second depression parallel to the first surface gradually increases from the first surface toward the second surface.

10. The method according to claim 1, wherein the first liquid-resistant protective film is a thermal oxidation film.

11. A method for manufacturing a nozzle plate, the method comprising:

forming the nozzle plate by using the method according to claim 1.

12. A method for manufacturing a droplet discharge head, which includes a nozzle plate that has a plurality of nozzle holes from which a liquid is discharged, a cavity substrate that has a plurality of cavities in which the liquid is contained, and a pressure generator that discharges the liquid to the cavities, the method comprising:

forming the nozzle plate by using the method according to claim 1.

13. A method for manufacturing a plate, the method comprising:

forming a first etching mask on a first surface of a silicon substrate;

forming a first depression in the first surface of the silicon substrate by a first etching;

removing the first etching mask;

forming a first liquid-resistant protective film on the silicon substrate, the first liquid-resistant protective film having liquid resistance;

reducing the silicon substrate to a desired thickness from a second surface side opposite to the first surface;

forming a second etching mask on the second surface of the silicon substrate;

forming a second depression in the second surface of the silicon substrate by a second etching; and removing the first liquid-resistant protective film.

14. The method according to claim 13, further comprising:

forming a second liquid-resistant protective film on the silicon substrate, the second liquid-resistant protective film having liquid resistance.

15. The method according to claim 14, further comprising:

forming a liquid repellent layer on the silicon substrate, the liquid repellent layer having liquid repellency.

16. The method according to claim 13, further comprising:

forming a liquid repellent layer on the silicon substrate, the liquid repellent layer having liquid repellency.

17. The method according to claim 13, wherein when the first liquid-resistant protective film is removed, an area that includes the second depression is removed.

18. The method according to claim 13, wherein when the first liquid-resistant protective film is removed, an outer circumference of the silicon substrate is not removed.

19. The method according to claim 13, wherein a thickness of the silicon substrate is reduced by grinding.

20. The method according to claim 13, wherein the first depression and second depression are formed by dry etching.

21. The method according to claim 13, wherein the second depression is formed by isotropic dry etching.

22. The method according to claim 13, wherein the second depression is formed by anisotropic dry etching.

23. The method according to claim 13, wherein an open area of the second depression is larger than an open area of the first depression.

24. The method according to claim 13, wherein a cross sectional area of the second depression parallel to the first surface gradually increases from the first surface toward the second surface.

25. The method according to claim 13, wherein the first liquid-resistant protective film is a thermal oxidation film.

26. A method for manufacturing a nozzle plate, the method comprising:

forming the nozzle plate by using the method according to claim 13.

27. A method for manufacturing a droplet discharge head, which includes a nozzle plate that has a plurality of nozzle holes from which a liquid is discharged, a cavity substrate that has a plurality of cavities in which the liquid is contained, and a pressure generator that discharges the liquid to the cavities, the method comprising:

forming the nozzle plate by using the method according to claim 13.

* * * * *